United States Patent [19]

Smith

[11] Patent Number: 5,048,235

[45] Date of Patent: Sep. 17, 1991

[54] PREDICTIVE HIGH WHEEL SPEED GRINDING SYSTEM

[76] Inventor: Roderick L. Smith, 2012 Greenfield La., Rockford, Ill. 61107

[21] Appl. No.: 271,721

[22] Filed: Nov. 15, 1988

[51] Int. Cl.[5] ..... B24B 53/00

[52] U.S. Cl. ..... 51/5 D; 125/11.01

[58] Field of Search ..... 51/5 D, 322, 262 T, 51/165.73; 125/11 R, 11.01–11.04

[56] References Cited

U.S. PATENT DOCUMENTS 2,420,504 5/1947 Stewart ..... 125/11 BS 4,535,572 8/1985 Smith ..... 51/5 D

OTHER PUBLICATIONS

Soviet Union reference 0,706782 Kabardino, Diamond Tool for Dressing Grinding Wheels, 12/5/79, (English Translation).

*Primary Examiner*—Frederick R. Schmidt

*Assistant Examiner*—Bruce P. Watson

*Attorney, Agent, or Firm*—Arnold, White and Durkee

[57] ABSTRACT

This invention is a new high wheel speed grinding process that uses only one very hard grade resin bonded grinding wheel of the desired abrasive grit size for the surface finish required, where simultaneously with the grinding of a workpiece the wheel face is conditioned and trued by a truing element heated to a temperature between 250° F. and 1200° F. at the truing rates required to provide grinding at quantitatively predictable desired and constant unit volume energy and metal removal rate values.

4 Claims, 5 Drawing Sheets

PREDICTIVE HIGH WHEEL SPEED GRINDING SYSTEM

BACKGROUND OF THE INVENTION

The present invention relates in general to new methods and apparatus for grinding workpieces with rotationally driven grinding wheels of known types which structurally comprise grits bonded in a cured supporting matrix of known material, such as phenol-formaldehyde resin, or epoxy resin, etc. In conventional use the grinding action on the workpiece is controlled by over thirty grinding input variables, many of which are unsteady with time of grinding (such as wheel diameter and wheel surface velocity), which results in an unsteady degree of flattening and dulling of the grits—causing a deterioration of sharpness, increase in power required, and incidence of metallurgical injury to the workpiece. Also the unsteady grinding action of the conventional system described above is accompanied by an unsteady degree of grits fracturing and breaking out of the supporting matrix so that the wheel wears down under other conditions-not only causing reduction in the wheel radius but also deterioration of the wheel face from the desired "form" or shape. In order to stabilize this situation new methods of grinding wheel truing/dressing are used on grinding wheels of known types which structurally comprise abrasive grits bonded in a cured supporting matrix of known organic material, such as phenol-formaldehyde resin, or epoxy resin, etc.

More particularly, the present invention relates to methods and apparatus for restoring or maintaining a desired degree of wheel face sharpness and/or shape of organic bonded wheels being operated at high wheel speeds which are much less safe for vitrified bonded wheels.

SUMMARY OF THE INVENTION

It is the general aim of the invention to vastly improve the speed, efficiency, surface integrity quality, consistency, and cost with which workpieces are precision ground by enabling the use of organic bonded grinding wheels at high wheel speeds which are not safe for vitrified bonded wheels.

More particularly, it is an object of the invention to control the sharpness and/or shape of an organically bonded grinding wheel face, despite the normal tendency for the wheel to become dull and lose its desired shape-by methods and apparatus which not only depart radically from known and conventional practices in the art, but which yield greater economy and higher productivity for the grinding procedure.

In the above regard, it is specifically the object of this invention to provide to high metal removal rate high wheel speed grinding, lower friction energy used per unit volume of metal removed, ($UVE_f$), than is presently the case either with conventional high wheel speed grinding or with conventional low wheel speed grinding.

In this latter respect it is object of this invention to provide the wheel face cutting sharpness that not only results in low $UVE_f$, but in very low level tensile stress, or compressive stress in the metal surface, in contrast to high level tensile stress provided by conventional high wheel speed grinding and with low wheel speed grinding.

It is the object of the invention to so control the interaction between the truing element and the face of an organically bonded grinding wheel so as to bring or maintain the latter to the desired sharpness, and shape at the cutting interface with the workpiece thus controlling the results at the cutting interface to desired values, despite the tendency of the unsteady grinding operation variables to change the results at the cutting interface away from the desired values.

Still another object of the invention is to obtain the foregoing advantages by wheel truing action which may transpire separately from or simultaneous with grinding, and then may be either intermittent or continuous, while the wheel is grinding on a workpiece-thereby saving time and increasing productivity of a given grinding machine.

A related object of the invention is to allow successful high wheel speed (for example 16,000 fpm) use of very dense, strong, and safe organic bonded grinding wheel specifications, which if used with conventional truing and dressing methods and grinding apparatus produce, high friction heat and metallurgical injury to the workpiece.

In general it is the aim of the invention to provide, through the conjoint control of the temperature of the truing element and the truing element force or feed rate, the desired level of sharpness for a variety of different grinding situations from one single grinding wheel specification—thereby avoiding the conventional expense of a variety of grinding wheels, and eliminating the time consuming and non-productive changing of wheels for different jobs.

In this latter respect it is the specific object of the invention to enable changing the effective grinding grade of the organic bonded grinding wheel during the grinding of a workpiece, where a vastly different wheel performance is required in different parts of the grind cycle, such as crankshaft main and pin bearings that also have thrust faces to grind adjacent to the cylindrical bearing surface; or for another example, rough and finish grind in one cycle.

It is a related object of the invention to enable using the same organic bonded wheel grade on vastly different types of grinding, such as cylindrical grinding and flat surface grinding—thereby saving much wheel changing time and wheel expense compared to conventional.

It is a further related object of the invention to enable using the same organic bonded wheel grade on vastly different types of metal, such as brass, cast iron, soft carbon steel, high carbon steel, alloy steels, and high strength thermal resistant alloys—thereby avoiding much wheel changing time and the great expense of a vast variety of wheels.

It is the specific object of the invention to eliminate the conventional requirement for a highly trained wheel specialist to study each job and recommend a particular wheel specification—thereby saving much time and reducing the cost.

It is a related specific object of the invention to enable the use of one grade of wheel, which will be the maximum strength wheel that can be manufactured—thereby preventing wheel explosions at high wheel speed, and preventing serious personal injury or loss of life, and damage to equipment.

In general it is the aim of the invention to substantially reduce truing element wear—thereby reducing truing element cost relative to conventional truing and dressing.

It is a specific object of the invention to reduce the cost of the truing element in contrast to the expensive diamond truing elements in conventional use, by enabling the use of less expensive materials than diamond.

It is the particular object of the invention to enable faster grinding and more accurate size workpieces with good metallurgical condition, where the structural stiffness of the workpieces is low and they cannot withstand without considerable deflection the high and unstable grinding forces produced in conventional grinding. Examples are long flexible workpieces, or hollow workpieces such as tubing or large diameter anti-friction bearing races, where because of higher wheel velocity and improved and stable wheel sharpness there is a lower and stable grinding force, and despite the fact that the grinding wheel being employed otherwise could only be fed into the workpiece with such small force and rate that the wheel would tend to rapidly dull.

Another related object is to successfully perform light finish grinding at low $UVE_f$ values under the control of the wheel truing, despite the tendency of light finish grinding to produce high $UVE_f$ values.

It is the object of the invention to vastly increase the productivity and lower the cost of particular plunge grinding operations by enabling the use of much wider truing elements than is possible with known practices in the art, due to lower force between the truing element and the grinding wheel, as compared to conventional practice.

A related general aim of the invention is to vastly improve the metal removal rate, productivity, and cost of rough grinding castings on floor stand grinders by making feasible the use of higher wheel speeds than is presently the allowed safety standard for this class of grinding by enabling the successful use of much stronger denser organic bonded grinding wheels that are not usable under known and conventional practices of wheel dressing.

It is the specific object of the invention to substantially reduce the time required to true, on the grinding machine, the sides of large diameter wheels in order to bring the wheel to a specified decimal tolerance wheel width—thereby making a substantial saving for those plunge grinding jobs that require the distance between plunge ground shoulders be held to tight tolerances, such as +0.002"/+0.004" or closer.

It is the object of the invention to vastly increase the speed and lower the cost of truing organic bonded grinding wheels in the wheel manufacturing truing operations, where large amounts of wheel relative to the grinding machine truing operation must be removed in the process of producing a specified size of grinding wheel.

It is the related object of the invention to enable the machining of special features into the abrasive grinding wheel, such as drilling holes in the wheel.

It is also a related object of the invention to increase the productivity and decrease the cost of machining and drilling structural plastic materials.

The specific aim of the present invention is to combine the attributes brought by Hot Truing with grinding machine design features that in many instances are, to the best of my knowledge, new in the art, and which in total represent a radical departure from known practices of the grinding art. It is the general aim of the invention to vastly enhance the speed, efficiency, accuracy, and consistency with which workpieces are ground to a desired size, shape and surface finish-relative to the speed, efficiency, accuracy, and consistency obtainable through known and conventional practices of the grinding art.

It is also the object of the invention to continuously operate the wheel cutting face at a constant known position relative to the machine base, which is presently not possible with conventional grinding, despite the inevitability that the grinding wheel wears in use to a smaller diameter.

In the above respects, it is an object of the invention to provide the workpiece module with a constant position grinding wheel cutting face relative to the machine base that has a constant sharpness and constant shape, regardless of the tendency of variation in a variety of operating variables to change this result, and in contrast to conventional grinding machines which do not maintain the shape, sharpness, or position of the grinding wheel face constant.

A related object of the invention is to make available to the workpiece module a grinding wheel cutting tool, such that a unit (for example 0.001") relative feed of the workpiece and the grinding wheel will always produce a unit (0.001") of removal from the workpiece surface, in contrast with the conventional grinding machines where a unit of relative feed of the workpiece and the grinding wheel produce an unpredictable combination of removal from the workpiece and removal from the grinding wheel.

Another related object of the invention is to significantly reduce the cost of computer control software by making usable previously written metal cutting software routines or sub-routines.

Another related object of the invention is to provide a grinding system where in-process workpiece gaging equipment is unnecessary and is eliminated.

In this latter aspect, it is an object of the invention to provide a grinding system where the feed rate, the rate of material removal from the workpiece, the power required, the rate of grinding wheel usage, and other related process information is quantitatively predictable and/or controlled at predetermined levels, thus lending itself to unattended computer machine control.

In this latter respect it is the object of the invention to provide for the first time to process engineers the quantitative process predictability in terms useful to the process planning function, or for the set up of the grinding machine.

It is also an object of the invention to provide a grinding system where the sharpness, and shape are continuously maintained at quantitative known and desired levels without human monitoring or intervention, thereby providing a vast improvement in the quality and consistency of product produced; thus lending itself further to unattended computer machine control.

It is a related object of the invention (with given performance set points) to arrange the control protocol of the system in such a way that the system can learn by itself in grinding on a new workpiece the optimum necessary values of system operating variables, and teach itself the constants of the performance predictability equations.

It is the specific object of the invention to significantly reduce the abrasive cost by designing a grinding system that can successfully grind a variety of parts with a variety of types of grinding and use only one grade of wheel hardness.

It is the object of the invention to provide a grinding machine where the grinding wheel cutting face is continuously kept in a constant known position relative to the machine base, despite the fact that the grinding wheel wears down in diameter as grinding proceeds.

It is the related object of the invention to simplify the design of a new camshaft lobe grinder, and eliminate the necessity with typical conventional lobe grinders of only being able to use the grinding wheel over a very limited part of their diameter, thus substantially reducing grinding wheel cost.

Another object of the invention is to provide a grinding machine where grinding wheel performance may be automatically changed in various parts of the grind cycle; such as in the grinding of crankshaft bearings with thrust face sidewalls where a vastly different wheel performance is required for the sidewalls and the bearing, or in the rough grinding and the finish grinding conventionally done in separate operations.

It is a specific object of the invention to modularize the machine design by function, so that all functions with the grinding wheel are in the wheel module and all functions with the workpiece are in the workpiece module.

It is an allied object of the invention to make the workpiece module easily separable from the master wheel module, and be replaced by another workpiece module characterized by a different workpiece configuration and type of grinding, thereby providing a great reduction in the capital cost and changeover time of adjusting high production transfer lines to product model changes.

It is an object of the invention to provide safe and fast automated machine grinding wheel change, thus providing to the user a vast improvement in flexibility and decrease in cost of grinding a variety of workpieces in small lot sizes.

It is an object of the invention to eliminate the normal requirement of conventional machines for the operator to adjust the wheel guard back as the grinding wheel diameter wears down, thus further lending itself to unattended computer machine control.

It is a related object of the invention to improve the safety against workpieces falling between the wheel guard and the grinding wheel by being able to further restrict the grinding wheel exposure angle at the front opening in the wheel guard compared to conventional machines with adjustable wheel guards.

It is a related object of the invention to eliminate the normal requirement of conventional machines for the operator to adjust the grinding coolant nozzle as the grinding wheel diameter wears down, thus further lending itself to unattended computer machine control.

It is an object of the invention to vastly decrease the wear of the abrasive grits on the metal being ground by eliminating the water based grinding fluid which catalizes the chemical reactions at the abrasive/metal contact point, and thus not only decreasing the abrasive costs but eliminating the coolant concentrate cost and the time cost of maintaining the coolant concentration and the coolant cleaning and filtering equipment.

It is a further related object of the invention to simplify the collection of grinding swarf by having the grinding contact zone continuously in the same place relative to the machine base and the wheel guard.

Another related object of the invention is to provide known and constant clearances to the grinding wheel and wheel guard from machine elements of the workpiece module, thus allowing safe higher speed motions to be designed for the workpiece module, and thus vast improvement in the UP time of the machine.

In general it is the aim of the invention in it's many objects to reduce the set up time required, compared to conventional machines, thus further improving machine UP time.

A related general aim of the invention is to provide for the first time an unattended computer controlled grinding machine that fills the need for the grinding process to be included in computer controlled manufacturing systems.

DESCRIPTION OF THE PREFERRED EMBODIMENTS

Figure 1A:
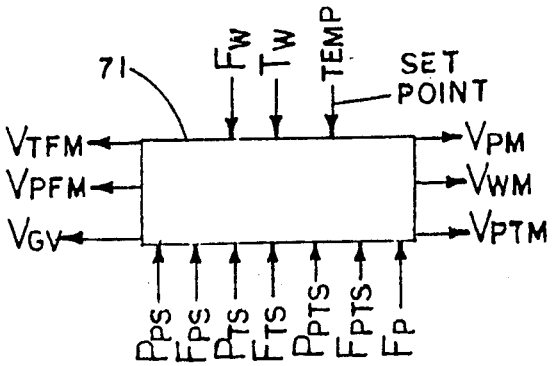
FIG. 1A is generalized representation of a control system to be associated with the apparatus of FIG. 1 in the practice of the present invention according to any of several embodiments.

Turning now to the drawings and referring first to FIG. 1, the grinding machine is here illustrated by way of example as a cylindrical grinder but the invention to be disclosed below is equally applicable to all other types of grinding machines such as surface grinders, roll grinders, internal grinders, etc. The machine includes a grinding wheel 30 journaled for rotation about an axis 30*a* and rotationally driven (here, counterclockwise) by a wheel motor WM. The wheel 30 and its spindle or axis 30*a* are bodily carried on a wheel slide WS slidable along ways of the machine bed 22. The wheel slide WS is connected through link 54 to lever arm 50, which is rotatable (within a small portion of a revolution) about axis 50*a* based upon motion of link 52 connected to the right end of the wheel truing slide TS. As shown with the line of action of link 52 a distance of 2D from axis 50*a* and the line of action of link 54 a distance 1D from axis 50*a*, the face 30*b* of the wheel is continuously kept at position 0 relative to the machine bed 22 when the face 30*b* is trued by truing element 62 carried on truing slide TS. Truing slide TS supports a fixed machine lead screw 64 and a rotatable nut 69, which is supported and journaled for rotation within a fixed portion of machine bed 22.

Work table 42 is supported on slidable ways on an intermediate work table slide 47, which is slidable on ways of machine bed 22. Face 30*b* of wheel 30 is brought into relative rubbing contact with the work surface 44*b* of a workpiece 44, and the workpiece is fed relatively into the grinding wheel by movement of the carriage 47 toward the right, to create abrasive grinding action at the workpiece/wheel interface.

In the exemplary arrangement shown, the workpiece 44 is generally cylindrical in shape ( or its outer surface is a surface of revolution) and is supported on fixed portions of the machine work table 42 but journaled for rotation about an axis 44*a*. The workpiece is rotationally driven (here counterclockwise) by a part motor PM mounted on the work table 42.

Any appropriate controllable means may be employed to move the slide 47 right and left along the bed 22, including hydraulic cylinders or hydraulic rotary motors. As shown, however, the slide 47 mounts a nut 45 engaged with lead screw 40 connected to be reversibly driven at controllable speeds by a part feed motor PFM fixed on the bed. It may be assumed for purposes of discussion that motor PFM moves the slide 47, and thus the part or workpiece 44, to the right or the left, according to the polarity of an energizing voltage $V_{PFM}$ applied to the motor, and at a rate proportional to the magnitude of such voltage.

It may also be desirable in carrying out certain aspects of the present invention to create a signal which represents the rate at which the slide 47 is being moved. For this purpose, a d.c. tachometer 46 is mechanically coupled to the lead screw 40 or to the shaft of the motor PFM, the tachometer producing a signal in the form of a d.c. voltage $F_{PS}$ which is proportional to the linear velocity or bodily feed rate of the slide 47 and which thus represents the rate $R'_P$ at which the radius of the workpiece 44 is being reduced. Of course, any of a variety of alternative feed rate sensors or signaling means may be employed.

Also, any suitable means are employed as a position sensor 48 coupled to the slide 47 or the lead screw 40 to produce a signal $P_{PS}$ which varies to represent the position of the part as it moves back and forth. In the present instance, the position of the part is measured along a scale 20 (fixed to the bed) as the distance between a zero reference point and an index point $47_I$ on the slide. The index point $47_I$ and zero reference on bed scale 20 are for convenience of discussion here shown as vertically aligned with the axis 44*a* and wheel face 30*b* respectively, and the signal $P_{PS}$ represents the position or horizontal distance of the part axis 44*a* relative to the wheel face 30*b*; which is the radius of the workpiece $R_p$. One suitable position sensor 48 may comprise a bi-directional pulse generator feeding pulses into a reversible counter whose digital count contents are applied to a digital-to-analog converter which produces the signal $P_{PS}$ as a variable d.c. voltage. Many other known forms of position signaling devices familiar to those skilled in the art may be used as a matter of choice.

In the practice of the invention in certain of its embodiments, as the abrasive grinding action is produced by the volumetric interference between the workpiece surface 44*b* and the wheel surface 30*b* (produced by bodily feeding workpiece 44 to the right) material is removed from the part surface and material is removed from the wheel surface, and (for a purpose to be explained) it is desirable to energize the truing feed motor TFM so as to cause feeding of truing element 62 and wheel slide WS to the left, and thus maintain the position of wheel face 30*b* relative to the bed.

Any appropriate controllable means may be employed to move the truing slide TS left or right along the bed 22, including hydraulic cylinders or hydraulic rotary motors. As shown, however, the slide TS mounts a fixed lead screw 64 engaged with a rotatable nut 69 connected to be reversibly driven at controllable speeds by a truing feed motor TFM fixed on the bed. It may be assumed for purposes of discussion that the motor TFM moves the slide TS, and thus the truing element 62, slide WS, and the wheel 30, to the left or right, according to the polarity of an energizing voltage $V_{TFM}$ applied to the motor, and at a rate proportional to the magnitude of such voltage.

In order to sense and signal the actual rate at which the truing element 62 is being fed, a d.c. tachometer 61 is mechanically coupled to the lead screw nut 69 or the shaft of the motor TFM, the tachometer producing a signal in the form of a d.c. voltage $F_{TS}$ which is proportional to the linear velocity or bodily feed rate of the slide TS and the truing element 62. Of course any variety of alternative feed rate sensors or signaling means may be employed.

Also, any suitable means are employed as a position sensor 66 coupled to the slide TS or the lead screw nut 69 to produce a signal $P_{TS}$ which varies to represent the position of the truing element as it moves back and forth. In the present instance, the position of the truing element 62 relative to the bed is measured, along a scale 20 (fixed to the bed), as twice the distance between a zero reference point and an index point 32 on the wheel slide WS. The zero reference point on the bed scale and the index point 32 are for convenience of discussion here shown as vertically aligned with the wheel face 30*b* and the axis 30*a* respectively, and the signal $P_{TS}$ represents twice the horizontal distance of the wheel axis 30*a* relative to the wheel face 30*b* (twice the wheel radius $R_W$, or wheel diameter). One suitable position sensor 66 may comprise a bi-directional pulse generator feeding pulses into a reversible counter whose digital count contents are applied to a digital-to-analog converter which produces the signal $P_{TS}$ as a variable d.c. voltage. Many other known forms of position signaling devices familiar to those skilled in the art may be used as a matter of choice.

In the practice of the invention in certain of its embodiments, it is desirable (for a purpose to be explained) to sense and signal the power which is being applied for rotational drive of the grinding wheel 30, and also to sense and signal the rotational speed of the wheel. While power may be sensed and signaled in a variety of ways, FIG. illustrates for purposes of power computation a torque transducer 35 associated with the shaft which couples the wheel motor WM to the wheel 30.

The torque sensor 35 produces a d.c. voltage $T_W$ which is proportional to the torque exerted in driving the wheel to produce the rubbing contact described above at the interface of the wheel 30 and the workpiece 44. The wheel motor WM is one which is controllable in speed, and while that motor may take a variety of forms such as an hydraulic motor, it is assumed to be a d.c. motor which operates at a rotational speed $D_W$ which is proportional to an applied energizing voltage $V_{WM}$. As a convenient but exemplary device for sensing and signaling the actual rotational speed of the wheel 30, a tachometer 36 is here shown as coupled to the shaft of the motor WM and producing a d.c. voltage $D_W$ proportional to the rotational speed (e.g. in units of r.p.m.) of the wheel 30.

Figure 1:
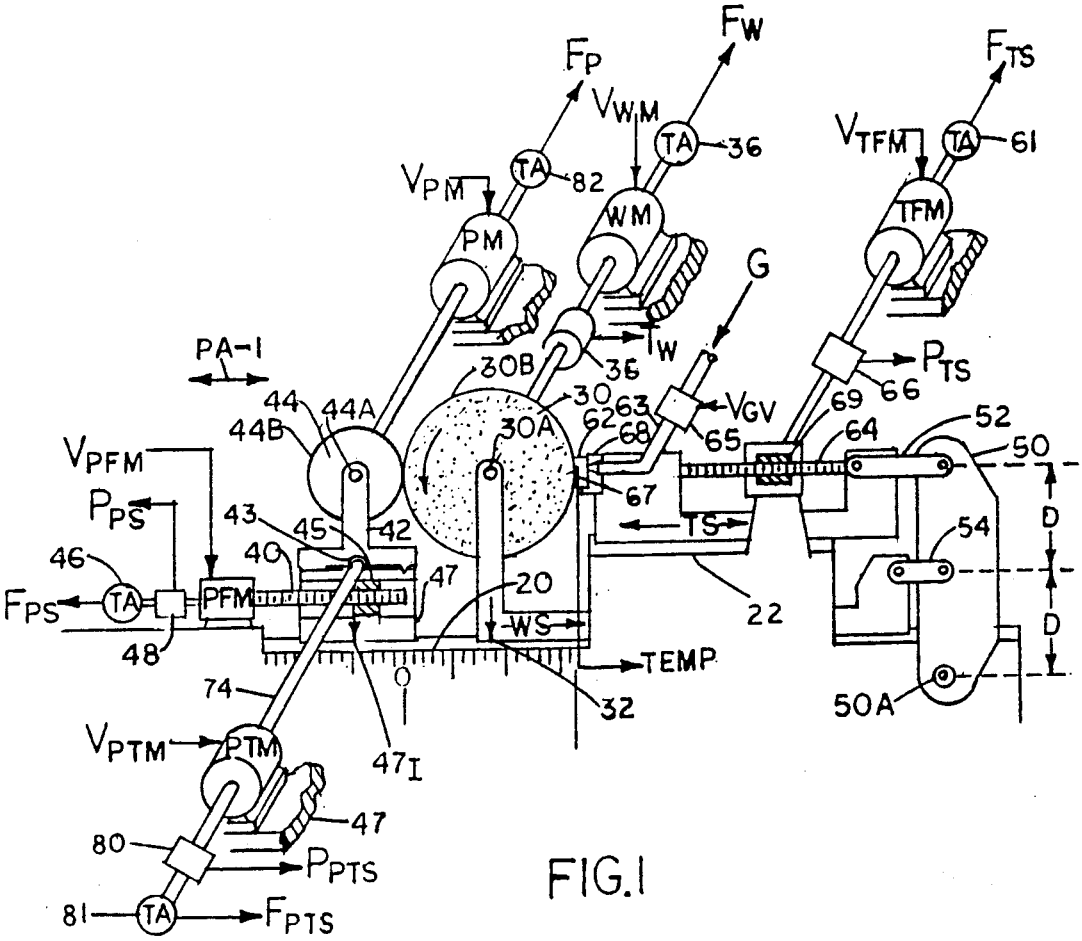
FIG. 1 is a diagrammatic illustration of an exemplary cylindrical grinding machine with rotational and feed drives for the various movable components, and with sensors for signaling the values of different physical parameters such as speeds, feed rates, positions, and torques.
Figure 2:
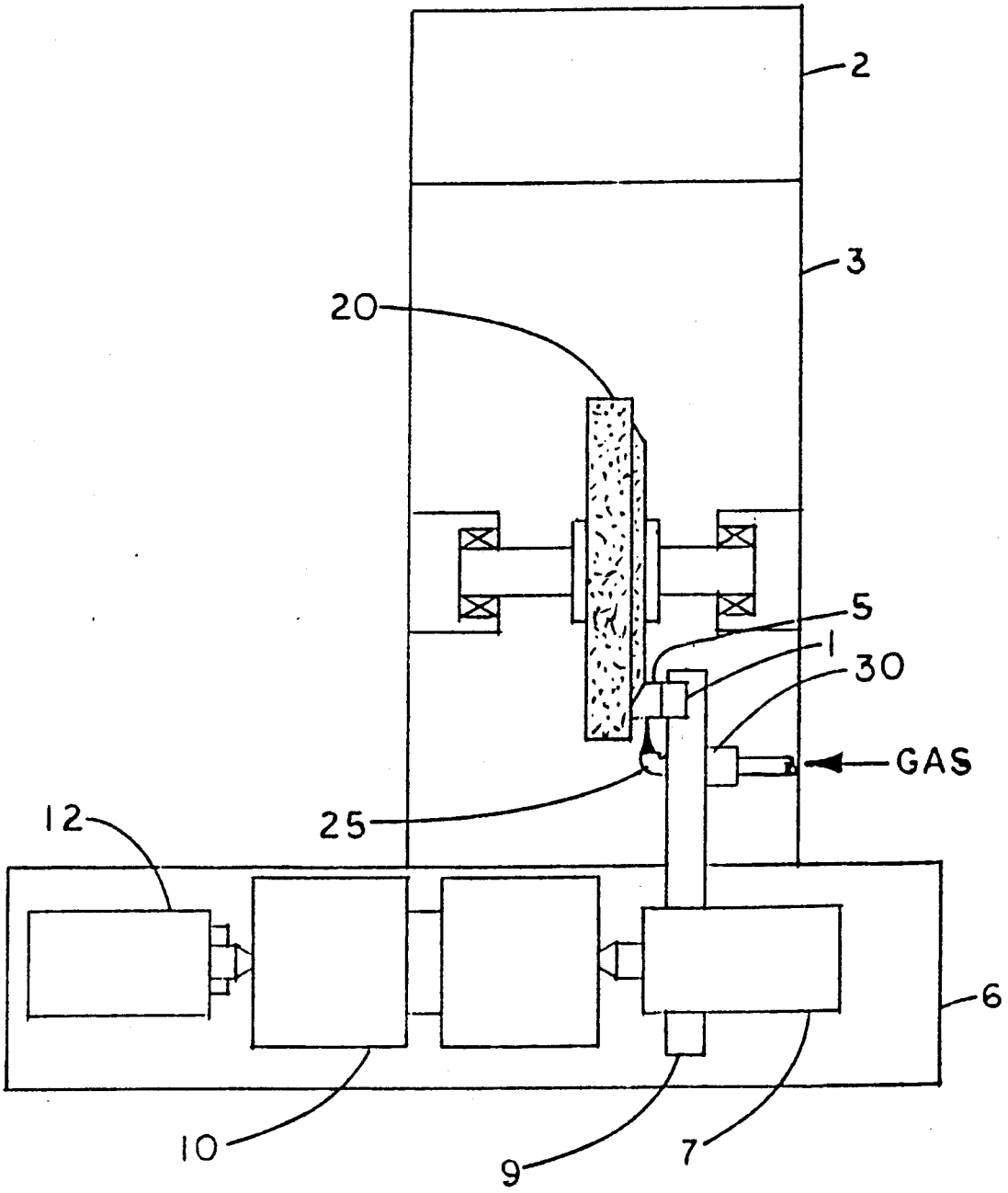
FIG. 2 is a fragmentary diagrammatic top view of a cylindrical grinder such as illustrated in FIG. 1, with the grinder arranged for the plunge grinding of a groove in a workpiece, and a truing device arranged to true the right side of the wheel in the process of bringing the width of the grinding wheel to the required width of the groove in the workpiece.

As shown in FIG. 1, in order to create abrasive grinding action at the work/wheel interface, the face 30*b* of the rotating grinding wheel is brought into relative rubbing contact with the rotating surface 44*b* of a workpiece 44, by feeding the work surface relatively into the wheel face by movement of the carriage 47 toward the right along path PA 1. This mode of cylindrical grinding is called "plunge" cylindrical grinding, and is used when the width of the work surface desired to be ground is the same width as the wheel face, as shown by FIG. 2.

In the practice of the invention in certain of its embodiments where the work surface to be ground is wider than the width of the wheel, called "traverse grinding", it is necessary to move the work laterally relative to the wheel. For this purpose work table 42 is arranged to slide laterally relative to the wheel 30 on ways of intermediate work table 47. Any appropriate controllable means may be employed to move the worktable 42 laterally on the intermediate work table 47, including hydraulic cylinders or hydraulic rotary motors. As shown, however, the work table 42 mounts a nut 43 engaged with lead screw 74 connected to be reversibly driven at controllable speeds by the part traverse motor PTM fixed on intermediate work table 47. It may be assumed for purposes of discussion that motor PTM moves the work table 42 and thus the part 44, laterally on the slide ways of intermediate work table 47, according to the polarity of an energizing voltage VPTM applied to the motor, and at a rate proportional to the magnitude of such voltage.

It may also be desirable in carrying out certain aspects of the present invention to create a signal which represents the rate at which the worktable 42 is being moved. For this purpose, a d.c. techometer 81 is mechanically coupled to the lead screw 74 or to the shaft of motor PTM, the tachometer producing a signal in the form of a d.c. voltage Ffts which is proportional to the linear velocity of the work table 42. Of course, any of a variety of alternative velocity sensors or signaling means may be employed.

Also, any suitable means are employed as a position sensor 80 coupled to the work table 42 or the lead screw 74 to produce a signal Ppts which varies to represent the position f the part as it moves back and forth. One suitable position sensor 80 may comprise a bi-directional pulse generator feeding pulses into a reversible counter whose digital count contents are applied to a digital-to-analog converter which produces the signal Ppts as a variable d.c. voltage. Many other known forms of position signaling devices familiar to those skilled in the art may be used as a matter of choice.

In the practice of the invention in certain of its embodiments, it is desirable (for a purpose to be explained) to heat the truing element 62 in FIG. 1 to some set point temperature TEMP, as signaled by thermocouple 67 mounted in the truing element 62, by application of a d.c. control voltage $V_{GV}$ to the controllable gas valve 65, and thereby regulate the gas flow G to burner tube 63 and thus control the truing element temperature to the set point TEMP. There are a variety of ways to heat the truing element known to those skilled in the art, such as gas, electric resistance heater, high frequency induction heating, etc.

FIG. 1A is a generic block representation of a control system 71 employed in the various embodiments of the invention to be described and which operates to carry out the inventive methods. In its most detailed form, the control system receives as inputs the signals $P_{PS}$, $F_{PS}$, CSIG. 1, CSIG. 2, $P_{TS}$, $F_{TS}$, $P_{PTS}$, $F_{PTS}$, $T_P$, $D_P$, $T_W$, $D_W$, $T_{TS}$, $D_{PTS}$, and TEMP produced as shown in FIG. 1 and FIG. 2; and it provides as output signals the motor energizing signals $V_{PM}$, $V_{WM}$ which determine the rotational speeds of the workpiece 44, and the wheel 30-as well as the signals $V_{PFM}$, $V_{TFM}$, and $V_{PTM}$ which determine the feed rates of the slide 47, the slide TS, and the slide 42; and it provides the output signal $V_{GV}$ for regulation of the gas flow in the truing element heater. Yet, it will be apparent that not all of the sensors, and signals representing sensed physical variables, need be used in the practice of all embodiments of the invention. Several typical but different embodiments will be described in some detail, both as to apparatus and method, in the following portions of the present specification.

FIG. 2 is a fragmentary diagrammatic representation of top view of a cylindrical grinder such as FIG. 1, with the grinder is arranged for the plunge grinding of a groove in the workpiece, and the exemplary truing device shown is arranged to true the right side of the wheel in the process of bringing the width of the grinding wheel to the required width of the groove in the workpiece. Alternatively, both sides of the wheel may be trued. The grinding wheel 20 is supported in bearings fixed to the wheel slide 3 which in turn slides on ways of the machine base 2. Item 6 is the table which slides on ways of the machine base 2, and supports the workpiece footstock 7, the workpiece 10, and the workpiece headstock 12 which rotates the workpiece. The truing element 5 is supported by the truing bar 9 mounted on the footstock 7, and it is heated by a gas jet 25, where the gas flow is automatically regulated to cause a set point temperature of the truing element by valve 30 in response to the signal of a thermocouple (known in the art) embedded in the truing element 5. Truing element 5 is shown with a bevel and a flat on the truing face. The amount of wheel removed and the amount of bevel shown is an exaggeration (for visual clarity purpose only) of the actual case where the amount of bevel is slightly greater that the amount of wheel to be removed, which is generally not more than .020". The combination of the bevel and the flat will later be explained more fully.

Figure 3:
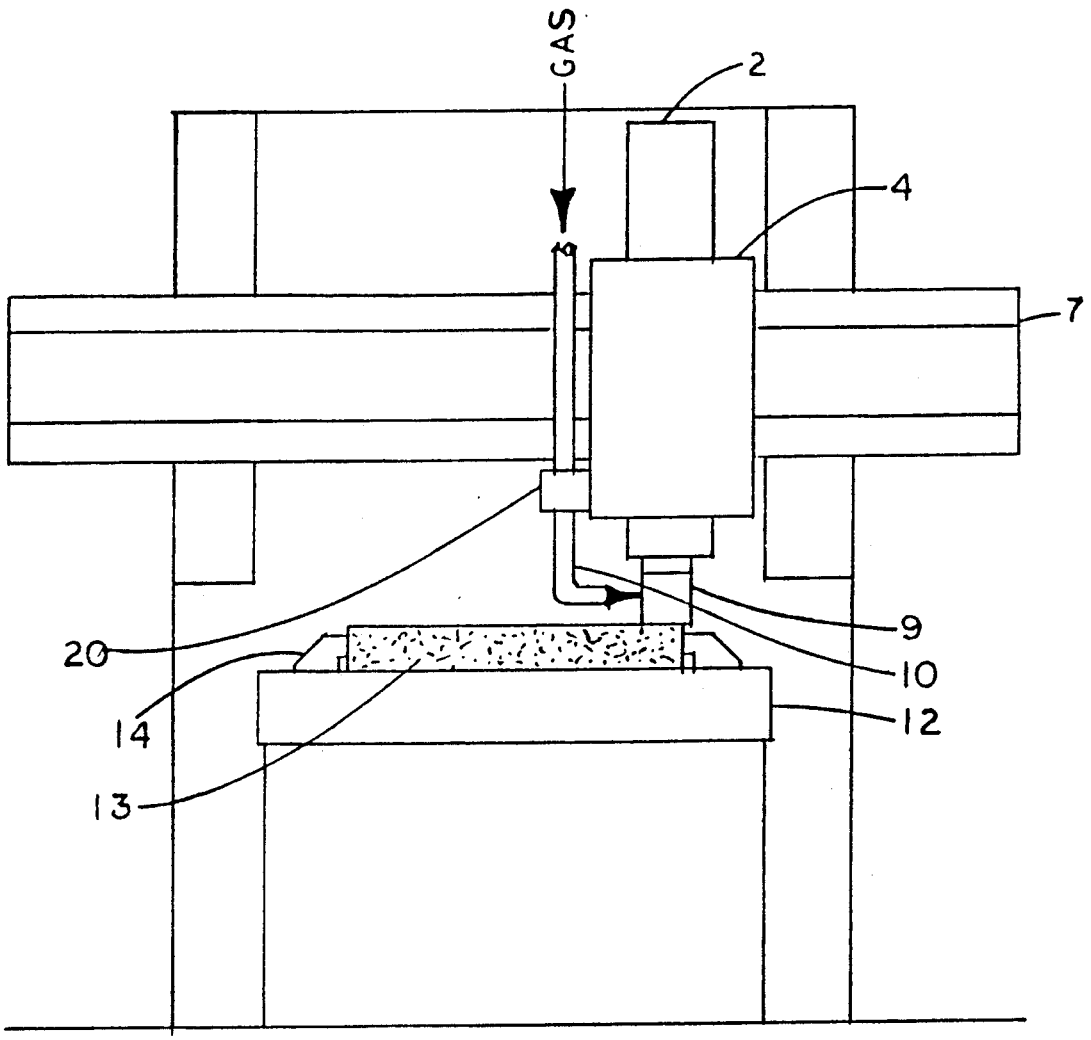
FIG. 3 is a fragmentary diagrammatic side elevation of a vertical turning lathe arranged for truing the side of a grinding wheel with a truing device.

FIG. 3 is a fragmentary diagrammatic representation of a vertical turning lathe showing the exemplary truing tool. Item 2 is the vertical ram, for the vertical positioning of the truing element 9 that is heated by gas jet 10, carried by the crosshead 4, that provides the crossfeed motion of the truing element across the grinding wheel. The gas jet 10 is heated to a set point temperature by the flow of gas regulated by gas valve 20 in response to signals from a thermocouple (known in the art) embedded in the truing element 9. Item 7 is the cross rail that supports the crosshead. The grinding wheel 13 is supported and rotated by the rotary table 12, and is held in place by a three jaw chuck of which 14 is one of the jaws.

Figure 4B:
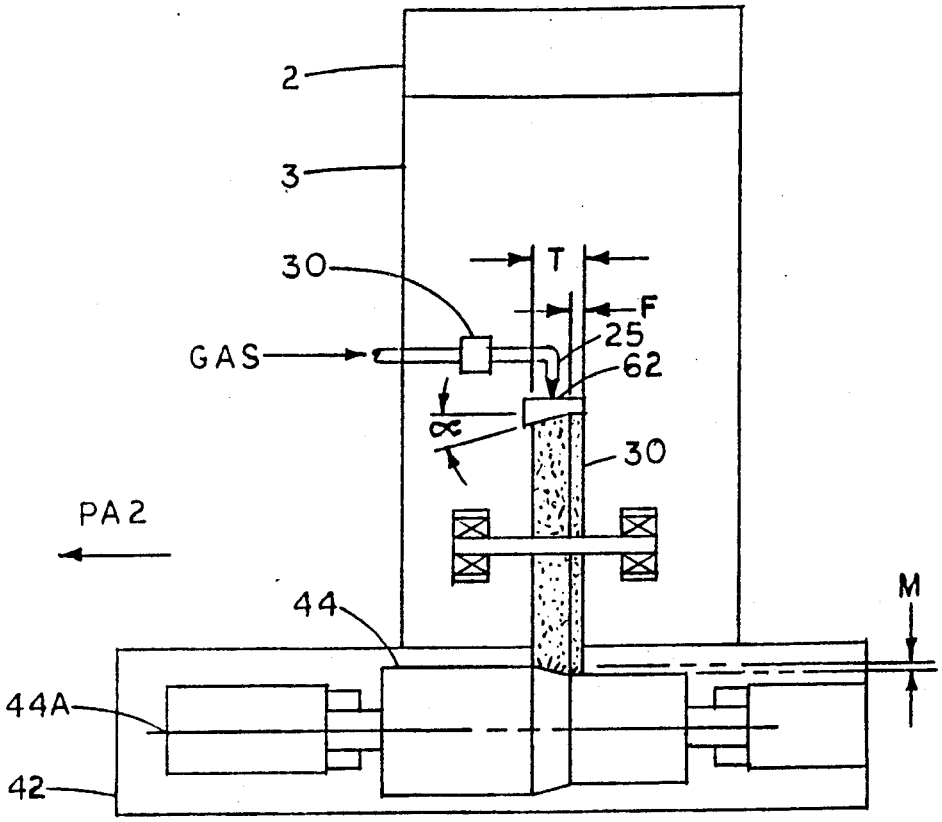
FIG. 4B is a fragmentary diagrammatic top view of a cylindrical grinder such as depicted in FIG. 1, except that it is arranged to grind a long cylinder.
Figure 4A:
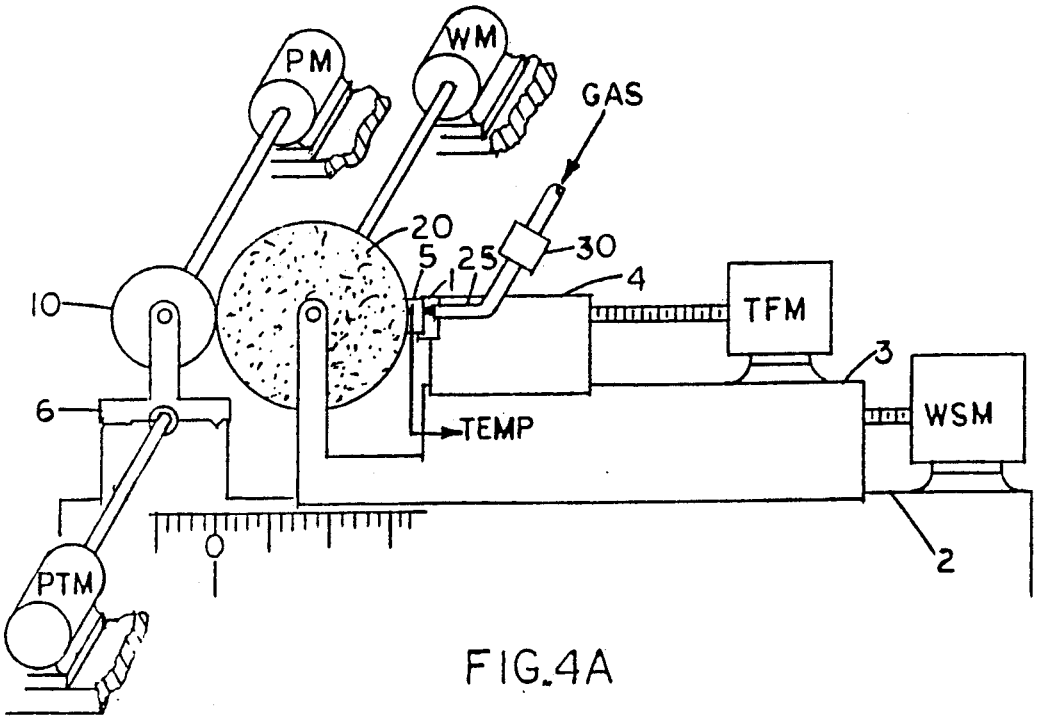
FIG. 4A is a fragmentary diagrammatic illustration of a cylindrical grinder which includes a truing device.

FIG. 4 is a fragmentary diagrammatic representation of a cylindrical grinder with an exemplary truing device. Item 4 is the truing slide, which carries the truing element 5, that is insulated by refractory block 1, and is heated by the gas jet 25, where the gas flow is automatically regulated to cause a set point temperature of the truing element by valve 30 in response to the signal of a thermocouple (known in the art) embedded in the truing element 5. The truing slide 4 slides on ways on the top of the wheel slide 3, and is moved by a machine screw turned by the truing motor TM that is supported on the wheel slide 3. The wheel slide 3 slides on ways on the top of the machine base 2, and is moved by a machine screw turned by the wheel slide motor WSM. Item 6 is the table which supports the workpiece 10, and positions it laterally in front of grinding wheel 20 by the turning of a machine screw by the part traverse motor PTM. The workpiece is rotated by the part motor PM, and the grinding wheel is rotated by the wheel WM.

There are a variety of ways to heat the truing element to a set point temperature known to those skilled in the art, such as gas, electric resistance heater, high frequency induction heating, etc.

FIG. 4B is a fragmentary diagrammatic representation of a cylindrical grinder of FIG. 1 arranged to grind a long cylinder where the cylindrical surface required to be ground is wider than the width of the grinding wheel, and where the exemplary truing device shown is arranged for truing a taper on the wheel face.

Figure 5:
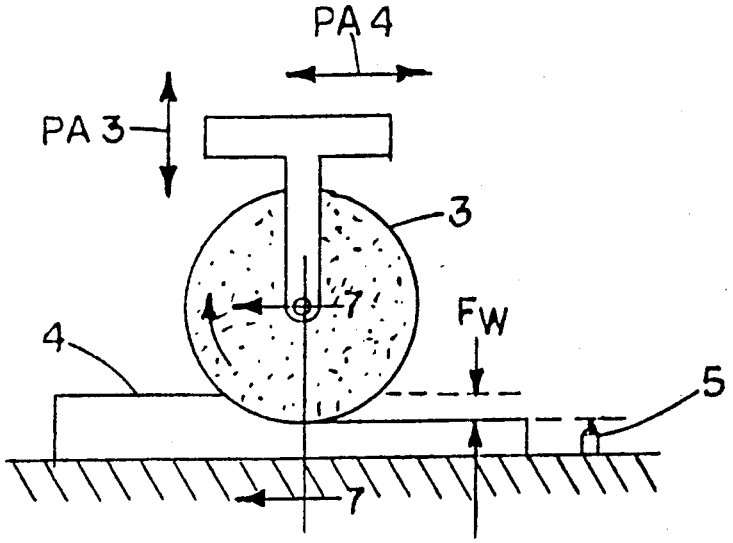
FIG. 5 is a fragmentary diagrammatic side elevation of a surface grinding machine (as contrasted to the cylindrical grinding machine represented in FIG. 1), and which illustrates the various relative motions for surface plunge grinding (where the width of the wheel is the same as the width of the work piece surface to be ground)

In the grinding of flat surfaces the relative motions required are somewhat analogous to those depicted with cylindrical workpieces, and to be specific consider FIG. 5, where the feeding of the rotating wheel 3 is along path PA 3, with an increment of feed $F_W$ into the workpiece 4 indicated. It is apparent that in order to remove material from the length of the workpiece the rotating wheel must have a relative motion with the workpiece along path PA 4. Thus the combination of an increment of feed $F_W$, and relative motion of the rotating wheel and the workpiece along path PA 4 results in material being removed by abrasive action from the workpiece (as well as material being removed from the wheel due to wheel wear). These two relative feeding motions are the only two required for surface plunge grinding, and result in creating a groove in the workpiece, such as depicted in FIG. 6.

Figure 6:
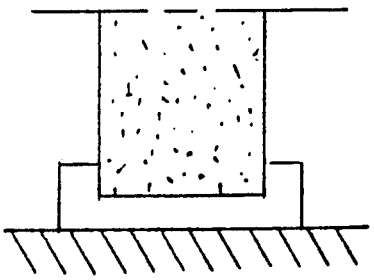
FIG. 6 is a vertical section, taken substantially along the line 6—6 in FIG. 5.

In plunge grinding the groove in the workpiece shown in FIG. 6 by the surface grinding motions shown in FIG. 5, the motion along path PA 4 is analogous in FIG. 1 to the workpiece rotary motion, except that in the flat surface case of FIG. 5 the workpiece radius has become infinite.

Figure 7:
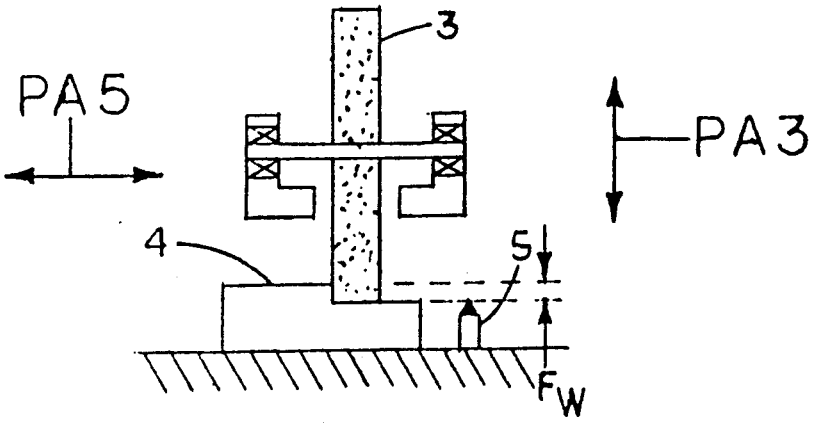
FIG. 7 is a fragmentary diagrammatic front view of a surface grinder such as depicted in FIG. 5, and which as a matter of background illustrates the various feed motions for surface traverse grinding (where the wheel width is less than the width of the work piece surface to be ground).

FIG. 7 is a fragmentary diagrammatic drawing of the surface grinder of FIG. 5, arranged for grinding a flat surface of workpiece 4. In order to cover this flat surface the rotating wheel and workpiece must have a relative transverse motion along path PA 5, in addition to the motions PA 4. In order to provide an interference between the rotating wheel and the workpiece an increment of feed along path PA 3 is supplied.

As long as the wheel cutting face is in a constant position then advantage can be taken of this by truing the face on a taper equal to the feed, this type of grinding can be handled without the problems it is faced with in conventional traverse type grinding. The FIG. 4B shows a diagrammatic sketch of a cylindrical grinder with a tapered truing element where the amount of taper is equal to the metal removal per pass.

This new concept of traverse grinding will increase metal removal rate over twenty five times conventional. With the typical amounts of stock removed from the part, calculation shows that a single pass could easily remove all the material, where many passes are necessary with conventional.

One of the most exciting time saving and quality producing features of the new concept of traverse grinding is the elimination of the conventional effect of wheel wear, which ultimately leads to a loss of grinding contact and loss of size or taper in the part, and non-productive wheel truing to re-establish a straight wheel face.

Traverse grinding on cylindrical centerless and centertype machines is a very large part of grinding, and has a high tonnage of chips produced, and a lot of energy used. It will be an important application area for the new concept because the degree of improvement will be so dramatic. At the much higher production rates, and with guaranteed surface finish and surface stress condition, the savings and quality improvement for manufacturing will be substantial. The specific applications that immediately occur to me are high volume removed per part such as, aircraft landing gear pistons, both new and rebuild; all the various sizes of hydraulic cylinder rods, including 6" diameter 10 ft. long rods for front end loaders and the like; ground steel bar and tube; steel mill rolls; paper mill rolls; and there are many more.

Applications 6: Many parts have flat surfaces requiring grinding, and what applies to traverse grinding round parts above also applies to flat parts. The technology of flat surface grinding has been, except for the relatively recent nitch created by creep feed, grinding, static for a long time, and I predict revolutionary change is possible in this field.

Traverse Truing: A type of truing where the configuration of the truing element/grinding wheel layout is characterized by the width of the wheel surface to be trued is greater than the width of the truing element active surface, and where truing is accomplished by the combination of an increment of relative feed and the relative bodily movement of the grinding wheel and truing element in a path essentially parallel to the wheel axis which causes progressive interference as the relative rubbing contact continues and by which the material of the wheel or workpiece respectively is progressively removed. It is of no consequence whether the wheel is moved bodily with the truing element stationary or vice versa, or if both the wheel and truing element are moved bodily.

Cam lobe grinding is another very important category of grinding, and with typical cam lobe grinding machines master cams must be manufactured to control the in and out motion of the cam lobe as it rotates in the grinder. This alone is a big expense, and inhibits engine or machine designers from experimenting with slight variations in cam lobe shape. A characteristic of lobe grinding is that the grinding contact point falls above and below the line of centers between the grinding wheel and the cam. The master cams are ground with certain diameter grinding wheels, and in the user cam grinding machine, in order to produce accurate lobe shapes the wheel diameter that is usable is restricted to a small percentage of the available wheel. This forces the abrasive cost to be relatively high on these type of operations. In order to hold the abrasive cost as low as possible, a compromise is made in wheel selection and harder grades are used, with the subsequent higher grinding UVE and the continual tendency to produce metallurgical injury on the lobe surface. A publicized example of this occurred several years ago with a well known auto manufacturer and a rash of failures of his diesel engine camshafts. I talked with the camshaft line foreman, and he complained that the grinder operators were making unauthorized increases in the feed rates on their machines beyond instructed values in order to earn more on the incentive system, and produced camshafts with metallugical injury that failed in service. His analysis was correct, and when the instructed feed rate was used the camshafts were satisfactory. However, a more informed understanding, showed that the original compromise of a harder grade to extend the usable wheel life, pushed up the UVE to the point that there was no safety margin left, and when the operators increased the feed rate the amount of power going into friction was increased sufficiently to immediately cause metallurgical injury. Thus it is seen that the original grade compromise that is made with cam lobe grinders is not only responsible for low usable wheel life and high abrasive cost, but it is indirectly responsible for much poor quality.

Applications 5: The design of the camshaft lobe grinder would be simplified, in that the constant known position of the wheel face would enable repetitive radial and vertical adjustment of the camshaft to keep the grinding contact at the known wheel face position continuously each camshaft revolution as grinding proceeds, in contrast to present methods; and where decreasing wheel diameter will not cause grinding an inaccurate cam lobe, as is the case with conventional. I believe that it will also develop that with low $HP_F$ and dry grinding that one or two revolution lobe grinding will be possible.

PRIOR ART PRACTICES IN GRINDING SYSTEMS

"Grinding is the preferred process throughout industry where high production and the highest level of quality and precision are required. However it is one of the least understood of metalworking processes. Therefore it is far more dependent on workshop experience and skills than on scientific knowledge and engineering principles. This greater dependence on skills means that the highest level of grinding quality is sometimes attained with difficulty, and that small batch grinding operations which require frequent change of setup are highly sensitive to the individual operator. In the face of these current limitations, industry must use grinding processes to produce even higher quality levels while reducing the in-process inventory of parts queued up around the grinding machine and drastically reducing the requirement for operator skills." [1]

[1] "Industrial Problems in Grinding" by Dr. Richard L. Kegg, Cincinnati-Milacron, Annals of the CIRP Vol. 32/2/1983.

A key point from the above industrial survey is that grinding is a "black art" with no quantitative predictability, in terms useful to the process planning function, or for the set up of the grinding machine; or furthermore for the prediction of under what conditions such problems as grinding burn, and grinding chatter will occur.

There is in existence a body of information on the grinding process that was made public in 1971 that disputes the findings given above. It is a little known book titled "Abrasives"[2], by L. Coes, Jr. Chapter 12 of this book is on the 'Theory of Grinding', and in that chapter Coes describes in mathematical terms the grinding process.

[2] "Abrasives" by L. Coes Jr., 1971 Springer-Verlag, New York. The Applied Mineralogy series.

Coes showed that the fundamental mathematical equation representing fixed feed grinding is:

$$\text{Power} = ((M \times a)/k)G + (VFR)(SE)(G/(G+Q)) ;$$

where

M is the constant coefficient of friction that is determined by the softer of the two materials, the metal.

a is the constant rate of attricous wear of the abrasive determined by the combination of the abrasive type, the metal, and the atmosphere at grinding contact.

* k is the constant abradability of the metal.
* VFR is the causal variable, volumetric feed rate (VFR), and by definition is equal to the actual metal removal rate (M) plus the metal removal rate lost to wheel wear. The metal removal rate lost to wheel wear is equal to the ratio of surface area of the part to the surface area of the wheel (Q) times the wheel wear rate (W).
* G is the "grinding ratio" = M/W.
* SE is the constant specific energy, and is a property of the metal alone and is independent of abrasive type, grinding force, and wheel velocity.

Using these relationships the fundamental equation of Coes is reduced to:

Power (a new constant)G + (SE)(M); where the new constant M is a combination of the constants , a, and k. This also points out Coes' concept that with grinding the power used is divided into two parts, one which is used in friction and the second which is associated with overcoming the internal cohesiveness of the metal. For instance it is easily observable on any fixed feed grinding operation that the higher the G Ratio is the higher the power requirement is and the worse the part heating and metallurgical injury problem. In this case, it is clear that the $HP_f$ is too high; the $UVE_f$ is the critical variable, not UVE, as was earlier thought.

Coes points out that with all his mathematical equations for grinding that there are certain assumptions made; (1) that the wheel is considered to be an isotropic body, and (2) that the description of the grinding surface does not change with time of grinding. He also follows that with the point that there are many grinding operations where these assumptions are not true, and that with these operations the tendency of wheels to become dull with continued grinding requires periodic wheel dressing. Any grinding practitioner will witness that grinding wheels do not always grind the same throughout the wheel life, or from wheel to wheel of the same marked specification. The tendency of the wheel cutting face to change with grinding, or due to variation in the wheel, is a change in wheel performance and is represented by a changing G Ratio.

It has been found that G Ratio is unstable and unpredictable. With G Ratio not predictable for various conditions, and not stable for fixed conditions then the friction power term in the fundamental equation for fixed feed grinding is not predictable and not stable. The friction power term is the base from which the separating force between the wheel and the part is derived; and force then is also not predictable and not stable. This high $HP_f$ is the cause of un-predictable grinding chatter. This same friction term is also responsible for the heat development in grinding and the cause of metallurgical injury of the part surface, and this is why the conditions under which metallurgical injury occurs in conventional grinding are not predictable.

Metal cutting systems of all types including grinding exhibit the characteristic that eventually the cutting tool gets dull and must be sharpened. In contrast to metal cutting where it is relatively easy to remove the tool and replace it with a sharp one, removal of the grinding wheel and replacing it with a sharp one is much more time consuming, and in the case of conventional vitrified bonded wheels it is an unsafe practice because of the danger of cracking or breaking the vitrified wheel. In addition the dulling cycle of metal cutting tools is predictable and a substantially long time compared to the typical dulling cycle of a grinding wheel, which is unpredictable and usually occurs within the grinding of several parts. This feature of grinding has reinforced the characterization of the grinding process as an art, and has led to arranging grinding machines with integral wheel face sharpening capability.

The operation of sharpening a grinding wheel involves temporarily reversing the role of the grinding wheel, in which it is made the part and a single diamond point tool is fed across the face of the rotating wheel one or more times removing one or more layers of abrasive particles. This operation is called wheel dressing, and is done specifically to remove dull abrasive particles, and restore the wheel face to a sharper condition.

When the grinding wheel is first mounted on the grinding machine the wheel periphery is not exactly concentric with the axis of rotation, and it is necessary to employ the same diamond tool in a similar manner to remove enough layers of wheel face to establish concentricity; and the transverse path of the diamond tool may follow a convoluted path which establishes a geometric form to the wheel surface. This operation is called wheel truing. Although it may not always be the case, truing generally leaves the wheel face in about the same sharpness condition as dressing.

Many grinding operations are for grinding a form in the part, for example ball bearing races. Upon initial mounting of the wheel not only concentricity must be established, but the exact geometrical form must be trued into the wheel face by causing the diamond tool to follow a form template as it traverses across the wheel face. Here again with relative unpredictability compared to metal cutting, not only is the dulling cycle a problem, but the maintenance of the precision geometrical form of the wheel face may be a bigger problem. In this case truing and dressing become synonymous.

Single point truing/dressing is still the preferred method in industry for getting the sharpest wheel face, however a newer and faster method of using powered rotating diamond impregnated rolls that cover the full width of the wheel face has come into use. These rolls, which may be either straight face or formed face, have one disadvantage in that the resulting wheel face is not as sharp as compared to single point dressing. In essence, the powered rotating diamond roll is actually grinding the face of the grinding wheel and it leaves the abrasive points flat, and to some degree dull.

In contrast to this method there is the crush truing method which forces a formed tungsten carbide roll against the wheel face and rotates the wheel very slowly allowing the carbide roll to freewheel. Gradually the wheel face is formed to the shape of the carbide roll because the vitrified wheel bonding cannot stand the force and crushes away. This method has the advantage that it results in a sharper wheel face than even single point truing, however the big disadvantage is the high cost of the carbide crushing rolls, and the high force necessitates a very strong machine for accurate results, an additional cost. For obvious reasons crush truing is limited to vitrified bonded wheels and not applicable to organic bonded wheels.

All of the above methods of truing and dressing were originally developed for and are used primarily for vitrified bonded wheels. As resin and rubber bonded wheels were developed and came into use it was found the only method that would result in a usably sharp wheel face was the single point method. However even the single point method did not do a very good job of sharpening the wheel face—relative to what was the case with the vitrified wheel. The organic bonds had a resilience that reacted differently than the vitrified bonds, and resulted in much more machining off the abrasive points than exposing fresh sharp points.

The subject of dressing and truing is complicated by the various grinding wheel organic bond types, and something should be said here, by way of background, on these bonds. From the book, Abrasives, "Some, notably rubber and shellac are extensively used where considerable amounts of metal must be removed with the best possible finish and the least possible metallurgical damage to the workpiece. Shellac, for example, is extensively used in cutlery grinding and in the tool room for cutting off hardened steel. It is also use in grinding rolls when the best possible finish is required. Rubber is also extensively used in cutting-off wheels. Rubber bonded products are also widely used in cylindrical operations, particularly in centerless grinding and in the finishing of ball bearing races.

Other organic bonds such as alkyd resins have been introduced with the hope of replacing rubber and shellac, but these have made little progress.

Phenol-formaldehyde or resinoid-bonded wheels make up by far the largest part of the organic-bonded products. These are the standard products for rough grinding in the foundry and the steel mill. Resinoid wheels are used to some extent in fixed feed, or precision grinding, in special operations, such as thread grinding, and drill fluting."

Another organic bond that has made its appearance in recent years is the cast epoxy bonded wheel, and is covered by U.S. Pat. Nos. 3377411, 3391423, 3850589, and 3864101. This type of grinding wheel, in recent years, has found an accelerated use in all types of controlled feed precision grinding operations.

Truing and dressing is also complicated by variation in the grade of the wheel, and by way of background something should be said about grade. From the book, "Abrasives", "The grade of the wheel is probably the most important single factor in grinding wheel selection and is the most difficult to define in an exact manner. It is meant to signify the hardness or strength of the wheel on an alphabetical scale on which A is soft and Z is hard. The significance of the actual letter is defined in various ways depending on the bond type. The definition within the bond type is carefully controlled by the manufacturers because it, more than anything else, controls the reproducibility of the grinding results in the user's operation."

Since organic bonded wheels are stronger and more resilient than vitrified bonded wheels they can stand a higher wheel speed without exploding. Higher wheel speeds are generally desirable because metal removal rate increases about in proportion to increases in wheel speed. Unfortunately, at higher wheel speeds the machining of the abrasive points flat in the wheel dressing operation is worse, even, than at low speed; and produces a wheel face that was already so dull that it will not grind a part satisfactorily. The higher wheel speed is itself causing more friction heat and coupled with the very poor sharpening job, it is practically impossible to grind a part without introducing so much heat to the part surface that blue to black surface burn is left on the part. This also happens with lower speed vitrified wheels if they are not dressed often enough. In any event the expansion of high wheel speed precision grinding has been very limited. There have been some efforts to suitably strengthen vitrified wheels by special bonding so they would not explode at higher speeds, however this has not resulted in a completely satisfactory solution to the safety problem or to the heat problem at higher speeds.

Not only is grinding, including the allied operations of truing and dressing, characterized as an art, but there is no measurement for sharpness. Published research work has shown that all other conditions remaining constant, a dull wheel requires more energy to remove a given volume of metal from a workpiece, than does a freshly dressed wheel. It is general practice to define this energy of removal as "specific grinding energy" (SGE), and I have followed conventional practice in my previous U.S. Patents. However, it is not technically correct since the specific energy changes as metal removal rate from the workpiece changes, and it is therefore not specific to anything. Hereinafter I will call the energy to remove a given volume of metal, "unit volume energy" (UVE). If one then defines "unit volume energy" (UVE) as the ratio of (i) the power applied to effect grinding to (ii) the volumetric rate of removal of material from the workpiece, then a wheel when dull will operate with a higher UVE than the same wheel when sharp. Where references call out specific grinding energy or SGE, it should be understood in terms herein used to mean UVE.

I have observed in research tests with conventional grinding that G Ratio is unstable within tests at constant conditions, and unpredictable from condition to condition.

Conventional precision grinding systems of any configuration with only a few exceptions are arranged on the basis that the machine elements enable creating the interference between the rotating grinding wheel and the workpiece, such that the rubbing contact thus produced causes material to be removed from the workpiece and material to be worn off the grinding wheel, where the sum of the linear measure of the two material removals is equal to the linear interference (or feed) created by the machine elements. The latter feature of grinding (sum of the two material removals equals the linear feed) relative to metal cutting is one of the primary things that has kept grinding an art while metal cutting is a science. For example in metal cutting if the feed is 0.001" there is 0.001" removed from the workpiece surface, whereas in grinding if there is 0.001" feed the proportion which is material removed from the workpiece surface and the proportion that is removed from the grinding wheel surface is variable and not quantitatively predictable (and thus becomes an art). In grinding there are over thirty variables that influence the proportion of material removed from the workpiece versus material removed from the wheel. This lack of quantitative predictability is one of the primary features of conventional grinding that has prevented NC controlled machines from making the great strides forward in grinding that they have made in metal cutting, and is also the main block to unattended computer controlled grinding machinery.

The present practice in grinding crankshaft bearings with thrust face sidewalls, as well as ring roll dies, and other parts, is to compromise on the choice of grinding wheel grade as decided between the extremely different requirements of grinding the sidewalls at a modest speed and grinding the cylindrical bearing without metallurgical injury to the surface. Normally it is the practice to have such different requirements handled by separate grinding operations, however with these parts the blend between the sidewall grind and the cylindrical bearing surface grind must be perfect in the radius at their juncture, and in addition the radius has tight tolerance limits. The compromise forces a slow sidewall grind to keep the wheel corner from wearing a step or taper, and forces a relatively hard grade wheel be used to resist this wear; and this hard grade wheel grinds the cylindrical bearing surface with a high UVE and constant tendency of producing metallurgical injury. Many attempts have been made to use special harder grade sides to the grinding wheels, but these tend to produce a step where the hard grade side ajoins the softer grade center, and have thus not gained any widespread use. This category of grinding continues today to suffer high cost and high scrap rate because the compromise is necessary.

Conventional precision grinding systems may also exhibit a feature of very fast and unpredictable cutting face dulling cycles of the order of seconds or fractions of seconds, in contrast to metal cutting where the cutting tool life dulling cycle is much longer of the order of many minutes and is quantitatively predictable. This feature has reinforced grindings position as an art, and has led to arranging grinding systems with wheel face sharpening capability (wheel truing/dressing) as part of the machine, in contrast to metal cutting where the dull tool is replaced with a sharp tool and all tool sharpening is done in the tool room.

When a grinding wheel is actively grinding a workpiece, two things usually occur. At the commonly accepted ranges of feed rates and speeds used with a given wheel acting on a given workpiece material, the wheel becomes progressively duller; the torque required to drive the wheel increases; and if the speed of the wheel rotation is maintained, the wheel driving power increases until it reaches or exceeds the maximum, safe power at which the wheel-driving motor is rated. More heat is generated at the workpiece surface and the possibility of "burn" or metallurgical damage at the work surface increases as the wheel becomes duller and duller and more power goes into friction.

As a second effect, however, the wheel face may wear down (reduce in radius) unevenly so that its original, desired shape will deteriorate. This is especially troublesome when "formed" wheels (having wheel faces which are not purely cylindrical in their desired shape) are being used. To grind the desired shape on a work surface rubbed by the wheel, the wheel face must conform rigorously to that desired shape.

It is the prior practice in the industry, therefore, to periodically "dress" a wheel face, i.e., to "sharpen" its grits, as it becomes dull. In simple systems the wheel is "dressed" after each of successive predetermined time periods of grinding have elapsed or a certain number of workpieces have been ground.

When loss of form or shape occurs, the wheel must be "trued" to restore its shape.

The convention will be established that herein the word "truing" will be used to describe what is conventionally described by the words of "dressing" and "truing".

It is prior art practice in the industry to separate the rough grinding and finish grinding into two separate operations where the grade of the wheel is made softer for the lower feed rate finish grinding. Also in a similar manner it is common practice on hollow thin walled workpieces, such as large diameter bearing races, to restrict the feed rates to low values coupled with using softer wheel grades in an effort to restrict the build up of high grinding force causing deflection of the workpiece and inaccuracy. Also, and for the same reason it is common practice on center type cylindrical grinding of compliant workpieces to restrict the feed to low values and use softer grades.

Published research has shown that heating of the workpiece surface and metallurgical injury occur when the UVE is to high, regardless of the wheel speed. Modern metallurgy has brought the understanding that there was so much grinding heat that metallurgical changes take place in the metal surface that caused it to either loose it's hardness, or even to crack, either of which result in scrap parts. The application of non-destructive X-ray defraction testing to ascertain the stress condition of the ground surface of parts has revealed that many parts ground with conventional practice have a high level of tensile stress in the ground surface. X-ray defraction testing has shown that workpieces ground at lower UVE levels than conventional have either very low level tensile stress or even compressive stress in the ground surface. Engineers feel that there is a direct connection between high level tensile stess in the ground surface and the initation of fatique cracks in the workpiece under operating conditions.

For the stronger more resilient organic bonded wheels that are safe up to operating speeds of 16,000 rpm, and higher under special conditions, the subsequent grind immediately after a single point dress exhibits a relatively high UVE, and the ground surface may show metallurgical injury, or at best only a few parts can be ground before another dress is required. In fact, if diamond roll dressing is employed, metallurgical injury is most likely to occur immediately after dress.

So far as the applicant is aware, those skilled in the art have not suggested truing or dressing of organic bonded wheels by systematic control of the truing element temperature, nor of the systematic conjoint control of truing element temperature and truing force, nor of the systematic conjoint control of truing element temperature and truing rate.

DEFINITIONS AND SYMBOLS

From the introductory treatment of FIG. 1, it will also be apparent that the following symbols designate different physical variables as summarized below:

WR = power, i.e., energy expended per unit time.

$PWR_W$ = power devoted by the wheel motor to rotationally drive a grinding wheel.

$PWR_p$ = power devoted by the part motor to rotationally drive or brake the part (workpiece) to create, in part, the rubbing contact with the wheel.

$PWR_{WG}$ = that portion of PWR devoted to grinding action.

$PWR_G$ = total power devoted to grinding action.

$TOR_W$ = torque exerted to drive the wheel.

$TOR_P$ = torque exerted to drive or brake the workpiece.

$TOR_{WG}$ = that portion of total wheel torque TORW applied to rubbing action at the grinding interface, when truing and grinding simultaneously.

$TOR_{TS}$ = torque required to move the truing slide and true the wheel.

FOR = the force, in a direction tangential to a grinding wheel periphery, on a grinding wheel, or a workpiece due to rubbing action.

$D_W$ = rotational speed of grinding wheel (typically in units of r.p.m.)

$D_p$ = rotational speed of workpiece, i.e., the part to be ground.

$S_W$ = the surface speed of the grinding wheel (typically in feet per minute).

$S_p$ = the surface speed of the workpiece or part.

$R_W$ = radius of grinding wheel.

$R_P$ = radius of workpiece or part.

$P_{WS}$ = position of wheel slide.

$P_{TS}$ = position of truing slide.

$F_{WS}$ = feed rate (velocity) of wheel slide.

$F_{TS}$ = feed rate (velocity) of truing slide.

$F_{PS}$ = feed rate (velocity) of part slide.

$R''_W$ = rate of radius reduction of wheel.

$R''_P$ = rate of radius reduction of part being ground.

L = axial length of wheel face or region of grinding contact.

M'' = the volumetric rate of removal of material (metal) from the part being ground. Exemplary units: cubic inches per min.

W'' = the volumetric rate of removal of material from the wheel. Exemplary units: cubic inches per min.

NOTE: Any of the foregoing symbols with an added "d" subscript represents a "desired" or set point value for the corresponding variable. For example, $D_{WD}$, represents a commanded or set point value for the rotational speed of the wheel.

Certain ones of the foregoing symbols will be explained more fully as the description proceeds.

UVE = Unit Volume Energy; the ratio of (i) energy consumed in removing workpiece material to (ii) the volume of material removed. Exemplary units: Horsepower minutes per cubic inch, or gram-centimeter seconds per cubic centimeter. The same ratio is represented by the ratio of (i) power (energy per unit time) to (ii) rate of material removal (volume of material removed per unit time)—i.e., PWR/M'. Exemplary units: Horsepower per cubic inch per minute, or gram-centimeters per second per cubic centimeter per second.

$HP_f$ = Horsepower of friction.

$UVE_f$ = Unit Volume Energy of Friction; the ratio of (i) friction energy expended in removing workpiece material to (ii) the volume of material removed. The same ratio is represented by the ratio of (i) power expended in friction (energy per unit time) to (ii) rate of material removal (volume of material removed per unit time). Exemplary units: Horsepower per cubic inch per minute, or gram-centimeters per second per cubic centimeter per second.

Relative Truing Feed: The relative bodily movement of a grinding wheel and conditioning element in a path essentially perpendicular to the wheel axis which causes progressive interference as the relative rubbing contact continues and by which the material of the wheel is progressively removed. It is of no consequence whether the wheel is moved bodily with the conditioning element stationary (although perhaps rotating about an axis) or vice versa, or if both the wheel and element are moved bodily. In plunge truing, feeding is a continuous motion and is expressible in units of velocity, e.g. inches per minute. In traverse truing, feeding is a discontinuous incremental motion and is expressible in units of distance, e.g., inches per traverse pass.

Relative Grinding Feed: The relative bodily movement of a grinding wheel and a workpiece in a path essentially perpendicular to the wheel axis which causes progressive interference as the relative rubbing contact continues and by which the material of the workpiece is progressively removed. It is of no consequence whether the wheel is moved bodily with the workpiece stationary (although perhaps rotating about an axis) or vise versa, or if both the workpiece and wheel are moved bodily. In plunge grinding, feeding is a continuous motion and is expressible in units of velocity, e.g. inches per minute. In traverse grinding, feeding is a discontinuous incremental motion and is expressible in units of distance, e.g., inches per traverse pass.

Plunge Grinding: The configuration of the grinding wheel/workpiece layout characterized by the width of the workpiece surface to be ground being equal to the width of the grinding wheel, and where grinding of the workpiece is accomplished by the relative grinding feed of the wheel and the workpiece in a path essentially perpendicular to the wheel axis.

Plunge Truing: A type of truing where the configuration of the conditioning element/grinding wheel layout is characterized by the width of the wheel surface to be trued being equal to the width of the conditioning element active surface, and where truing of the wheel is accomplished by the relative truing feed of the wheel and the truing element in a path essentially perpendicular to the wheel axis.

Material Removal Rate: This refers to the volume of material removed from a workpiece (or some other component) per unit time. It has the dimensional units such as cubic centimeters per second or cubic inches per minute. In the present application alphabetical symbols with a prime symbol added designate first derivatives with respect to time, and thus the symbol W′ represents volumetric rate of removal of material from a grinding wheel.

Volumetric Feed Rate: This term may be defined as the volumetric metal removal rate if wheel wear was zero. It is made up of the actual metal removal rate, and the metal removal rate that is lost because of wheel wear. It has the dimensional units such as cubic centimeters per second or cubic inches per minute.

A New and Basic Approach to the Grinding System

I have discovered that resin bonded grinding wheels can be dressed to give a very sharp cutting action by heating the truing element. The most elementary method I have used is a truing element that quickly gets very hot at the truing interface as a result of the rubbing action taking place. The truing element in this case was thin walled steel tubing, where the end of the tube gets red hot. The resulting wheel face subsequently grinds faster and with much lower power than is otherwise the case. I have designed and built a 10 HP high wheel speed research grinder, and I have demonstrated that if a ½″ diameter length of drill rod is forced against the high speed rotating grinding wheel under a constant force of 5 pounds the removal rate was 0.004 cu. in./-min. However if this same test was made, except that in addition a length of ½″ diameter thin walled steel tubing was simultaneously forced against another quadrant of the rotating wheel with a force of 10 pounds that the removal rate on the bar increased to 0.045 cu. in./min., twelve times greater than before.

In this work I have observed that as the end of the tubing gets hot that the color changes from dull red to white, indicating that the temperature of the end of the tubing is increasing. In this connection after the test, I have observed that there was considerable steel burr raised on the inner and outer edges of the tube, and I have concluded that as this occurred the amount of friction heat increased, and the temperature on the end of the tube increased as indicated by the color change.

This led to the hypothesis that if the force on the tubing was increased that the friction would increase and produce a higher temperature on the end of the tube.

To verify this I ran the following test. Condition 1 was with 10 pounds force on the bar and 25 pounds force on the tubing. Condition 2 was with 5 pounds force on the bar and 30 pounds of force on the tubing. Under Condition 2 the metal removal rate on the bar per pound of force on the bar increased 125%.

While an increase of cutting rate does indicate a sharper wheel, it was desirable to get UVE data, therefore suitable instrumentation was added to the research grinder to obtain data on power used during the grind, and the following test was made. Condition 1 was with 5 pounds force on the bar, and Condition 2 was with 5 pounds force on the bar and 6 pounds force on the tubing. Under Condition 1, grinding bar only, the UVE was 20 HP min./cu. in., while under Condition 2, grinding bar and tubing simultaneously the combined UVE for bar and tubing together was 7 HP min/cu. in. This was over a 60% reduction and it seemed safe to conclude that the simultaneous truing with the tubing made the wheel sharper. It also increased the metal removal rate on the bar similar to previous tests.

I have recognized that when one wishes to true a grinding wheel, the objective is to remove material from the wheel as fast as possible, regardless of whether it is a wheel manufacturing truing operation, whether it is the operation of truing a wheel to a specified width on a precision grinder for grinding slots or grooves, or whether it is the operation of truing the wheel cutting face to a desired shape and sharpness. In some embodiments my invention may embrace procedures employing a single truing element used somewhat like a lathe tool to shave off the grinding wheel, or to machine plastic. In certain other embodiments it may follow this similar procedure, but employ multiple truing elements, formed face truing elements that are duplicates of the form desired to be ground, or formed face elements such as the combined bevel and flat shown in FIG. 2.

In some embodiments my invention will find application and advantage in those cases where the truing element, either as a block or a rotating roll has an operative surface conforming to the desired shape of the wheel face-and wherein wheel material is removed by feeding the wheel face and the elements operative surface into rubbing contact with one another.

I have discovered that organic bonded wheels respond in a different manner than vitrified wheels because of the different characteristics of the two bonds, namely their response to heat and force. Of importance here, I have discovered that when an organic bonded wheel is trued with a hot truing element the resulting wheel face grinds with a much lower UVE, indicating a sharper wheel face; compared to the conventional methods of truing with a cold truing element that is even further cooled by water or water based grinding fluid during truing.

My invention was conceived fully by observing that an organic bonded grinding wheel wears in grinding more by the mechanism of the heat of grinding contact, than by the force of grinding contact. As a further example I have observed that, crush truing rolls operating at zero relative velocities with the grinding wheel but with high force levels, are effective in truing vitrified wheels, but do not work with resilient organic bonded wheels.

The use of resin bonded grinding wheels on precision grinding machines is severely limited by the inability to sharpen the wheel cutting face with conventional methods, and obtain as sharp a cutting face as desired, and is typical with vitrified wheels. This invention is a new technique and apparatus for truing resin bonded wheels and obtaining a sharp cutting face, by heating the truing element to a temperature somewhere between the curing temperature of the resin bond and the charring temperature of the bond. The effect of the heat transfer is to soften the bond in the affected zone of depth so that fresh sharp grits are exposed easily and without damage to the grits, and where the wear on the truing element is minimized; in contrast to conventional truing without heat, where the truing act actually dulls the abrasive points to flats, and causes substantial wear of the truing element.

For precision grinding machines where the requirement is precision control of the amount trued off the wheel, and precision geometry of the wheel face; the use of the steel tubing method is perhaps too coarse and imprecise. The truing element would be, for example, either a diamond truing block or a diamond truing roll, that was mounted on a precision slide and controlled in its motion toward the grinding wheel by a precision screw. The truing element would be heated by one of several available heat sources well known to those skilled in the art, such as electrical resistance heaters, electrical high frequency induction heating, or gas.

The truing element might in the alternative be a cubic boron nitride particle truing roll or block, or even tungsten carbide, or some other extremely hard and wear resistant material under these hot conditions.

The amount of mechanical truing action is small, therefore the truing force is small. With this situation of low force between the truing element and the grinding wheel it is possible to true with the same accuracy much wider formed face wheels than is presently the case. It is expected that the life of the truing element will be much longer, and at this time beyond estimation.

Resin bonded grinding wheels are cured at about 250° F., and the bond chars at less than 1200° F. For instance, in U.S. Pat. No. 3,377,411 column 11 line 57, it states, "The mold is then placed into an oven at approximately 250° F. for two hours." Also in this same patent on column 12 line 29, it states, "The composition of the abrasive annulus can be obtained by burn-out tests utilizing certain procedures to obtain the composition breakdown; and on line 39, it states "In such tests, sections of wheels of known weight and volume are placed in a crucible and fired for at least one hour in an oven maintained at 1300° F. During this period, all organic bond material is driven off as volatile matter."

The resin bonds used in grinding wheels are thermosetting, and further application of heat after cure is complete, degrades the strength of the bond, which makes them much easier to true, but more importantly because there is very little mechanical truing action required the remaining abrasive points are not damaged or dulled to the severe extent that is the case with conventional practice.

The truing element is heated to a temperature, somewhere between the cure temperature of the resin bond and the char temperature. It does not appear that the temperature is critical, except that the greater the temperature difference between the grinding wheel and the truing element the greater amount of heat will be transferred during the mutual contact of the two. The heat flow is given by the expression $q=hA(t_1-t_2)$ B.t.u. per hr., where h = the coefficient of heat transfer, B.t.u. per hr. per sq. ft. per degree F.; A = area, sq.ft.; and $t_1$ and $t_2$ = terminal temperatures, deg. F For a given rate of truing element feed, at a given grinding wheel speed, the zone of effected depth on the grinding wheel is proportional to heat flow q. This also might be stated as follows: For a given depth of effect on the grinding wheel, the truing element feed rate is proportional to heat flow q. For a given wheel width/truing element width the circumferential length of the truing element determines the "Area" in the expression above, and determines the heat flow q. Therefore a truing block of a certain "Area" would not require as high a delta temperature for a certain depth of effect on the wheel as would a circular truing roll with a very limited "Area" in contact with the grinding wheel. However, it is possible even with the circular truing roll embodiment to increase the delta temperature sufficiently to make up for the low "Area". The repetitive contact of each part of the wheel surface being trued with the hot truing element is made each wheel revolution, and at high wheel speeds this establishes practically a steady state heat flow.

It should be clear from the above formula that if a hot truing element is maintained in contact (but with no force) with a cold grinding wheel face the depth of effect depends upon the length of time the contact is held. Therefore if a certain truing rate is desired it is necessary to relatively feed the truing element and grinding wheel to remove material from the truing element. However, if it is desired to change the wheel performance from a high UVE to a low UVE it is not necessary to have a relative feed of the truing element and grinding wheel at all. It is only necessary to keep the two in contact at a certain temperature difference, and the grinding performance will reflect the effect of the heat. Keeping the two in contact may be done either by controlling the relative feed or the relative force. In this case control of the temperature of the truing element will determine the amount of effect obtained.

The Art of Grinding has shown that the same abrasive will grind successfully just about any material/job if the correct grade of wheel is used. As previously pointed out wheel grade of hardness is the most important variable in the wheel specification. It adjusts the wear resistance of the wheel to the requirements of the job. For instance, on the same job, a hard grade results in high $UVE_f$ while a soft grade results in a low $UVE_f$. The ability to achieve the same result with one grade by varying the temperature of the truing element offers a vastly superior way of changing wheel performance without physically changing the wheel to one of a different grade. This capability also extends to different types of grinding such as cylindrical and surface, where with conventional grinding different grades are required.

I have also discovered that in truing organic bonded wheels with hot truing elements it is more effective to true dry without the conventional water based grinding fluid. The ease of truing depends upon the transfer of heat from the truing element to the grinding wheel, and this is enhanced by a higher temperature differential between the wheel and the truing element.

In applications where speed of truing is paramount and/or where the wheel speed is low, such as in wheel manufacturing truing or in truing the sides of wheels to obtain the desired decimal wheel width it will be beneficial to combine a taper and flat on the truing element face. Here the taper will allow more wheel depth to be removed at each pass, and the flat will insure that the higher rate of truing traverse will not produce a thread on the wheel surface. The taper actually extends the "Area", and increases the heat flow.

As an example of the heat effect, a drilling test was made on a dense hard grade resin bonded silicon carbide abrasive grinding wheel (wheel specification C80-W2B, density of 2.7 gm/cc compared to the density of silicon carbide of 3.2 gm/cc) of drilling a ½" diameter hole through the ½" thick wheel. The drill used was a typical ½" diameter tungsten carbide masonry drill. In this case the "Area" was a constant value. At an axial drill force of 30 pounds and a drill speed of 750 RPM a cold drill would not drill a hole in the wheel, but would only wear away the drill. A duplicate new drill was tried under the same conditions after first heating the rotating drill with a propane torch for 60 seconds. The heated drill made a nice clean hole in the wheel in 12 seconds, and there was practically no wear noticeable on the drill.

As previously pointed out I have discovered that truing with a hot truing element made the subsequent UVE of grinding lower than conventional truing with a cold truing element. I have further discovered if while a workpiece is ground under constant radial force if simultaneous truing with a hot truing element is introduced that the rate of cut on the workpiece increases substantially. I have further discovered that if a workpiece being ground under constant radial force is heated to a higher and higher temperature within the range previously mentioned that the metal removal rate increases and the UVE decreases as the temperature increases. As an example, a test was run on my high wheel speed research grinding machine with the same wheel specification, C80-W2B, that was used in the drilling test. In this test a length of ½" diameter drill rod was forced against the rotating grinding wheel with a constant force of 5 pounds. Before each grind test the surface of the high speed rotating grinding wheel cutting face was heated by a propane torch flame. Between each test the rotating wheel was allowed to cool for ten minutes. The following data was obtained.

| Heating Time (sec.) | 0 | 60 | 180 | 300 |
|---|---|---|---|---|
| Removal Rate ($in^3$/min) | .004 | .041 | .068 | .085 |
| UVE (HP min/cu. in.) | 20 | 21 | 11 | 8 |

This test, and other tests previously mentioned have led to the notion that the rate of cut on the workpiece, the UVE, and $UVE_f$ required are basically related to the rate of abrasive grit replacement in the cutting face of the grinding wheel, regardless of whether the replacement rate occurred in the grinding act or in the truing act, or in some combination of the two.

I have conceived that if the truing rate is made to control the wheel wear rate then the known wheel wear rate can be automatically compensated for, and produce a grinding system where the metal removed is equal to the feed, which is unknown in the art. Then in conjunction with the truing rate (which fixes wheel wear rate) the setting of feed (which fixes metal removal rate) would fix the G Ratio. With this basic and favorable change in the system then many other design changes become possible and desirable. While all these additional design features are not necessarily inventions in themselves, they are features of a new total concept of the high wheel speed grinding system, and are impossible with conventional grinding systems.

I have observed that UVE is related to the causal variable of grinding, the volumetric feed rate (VFR), according to the power function. If we have grinding data exhibiting a stable G Ratio (where the decrease in G Ratio is proportional to the increase in VFR), then if VFR is plotted versus UVE on Log/Log graph paper the resulting graph is a straight line. I have further discovered that if such grinding data from two different wheel velocities is plotted that two straight lines occur that converge to a common point. Primarily because of the numerical value of the common point for the two velocities, and because of the logic and evidence provided by Coes, it is clear that the intersection of these two curves is the specific energy of Coes. As an example, for 52100 steel the SE is 1.1 HP min/cu. in.; not vastly different from what is reported for metal cutting in the MetCut Machining Data Handbook.

VFR may be defined as the volumetric metal removal rate if wheel wear was zero. It is made up of the actual metal removal rate, and the metal removal rate that is lost because of wheel wear. According to Coes this is expressed mathematically as follows.

$$VFR = M' + Q * W; \quad (3)$$

where M' is the actual metal removal rate in cubic inches per minute, Q for round parts is the ratio of the average part diameter of the metal removal lost to wheel wear, to the average wheel diameter, and W' is the wheel wear rate in cubic inches per minute.

Substitution of (3) in (2) gives the following expression.

$$UVE = a\,(M' + Q * W'); \quad (4)$$

I have perceived this solution as continuous and simultaneous wheel truing at controllable rates, so that even if the other thirty variables of grinding are out of adjustment, the rate of grit replacement can be controlled at desired levels by the simultaneous truing. With the predictive capability described by the above equations (3), (4), I have now conceived of a different kind of grinding system where the W' (grit replacement rate) is achieved by continuous wheel truing at rates calculated by the equations. If the W' that occurs in grinding is the necessary value then no actual wheel truing occurs; however if W' decreases for any reason, such as wheel dulling, the wheel truing picks up the difference. It is important here to recognize that the cutting interface does not know where the refreshment of sharp abrasive points is being done, and it really doesn't make any difference that some of it is occurring in the grinding act and some in the wheel conditioning act.

The New Grinding System

It has occurred to me that it would be feasible to set up a different kind of high wheel speed grinding system where a very strong safe resin bonded wheel would be used. Without continuous truing this hard grade wheel would be very unstable. The continuous truing would give a sharp wheel face, and with constant truing rate would control the wheel wear rate substantially constant at any desired value. By setting the metal removed (feed) in conjunction with the wheel wear (truing rate) a desired G Ratio could be obtained. This constant G Ratio would insure that the power going into friction would be constant at some desired value which resulted in no chatter and good metallurgical condition. By compensating for this known wheel wear rate the grinder would become like a lathe, where the feed would equal the metal removed.

The friction power term of the fundamental equation for grinding cannot conveniently be directly measured; however the SE of the second term of the equation is a constant and the metal removal rate is known from the feed rate, therefore the portion of total power going into cutting metal can be calculated and subtracted from the total measured power to give the friction power. This system would be predictive in nature, in contrast to the adaptive methods used in conventional systems. The quantitatively predictable and constant result features would allow a whole new approach to grinding machine design and control to be made that would bring many other benefits, as will be shown.

Feasibility of Dry Grinding: Chapter 14 in Coes' book is on "The Chemistry of Grinding". Here Coes shows that with a water based grinding fluid, the water actually catalyzes the chemical solubility of the abrasive with the iron. This type of wear is represented by the constant "a" in the friction loss term of Coes' fundamental equation for fixed feed grinding. Oil, used as a fluid is known to be beneficial, however the messiness, the fire hazard, and cost make it generally undesirable. A reduction in the $HP_F$ produced by hot truing can be further aided by eliminating the water and grinding dry. The fact that high wheel speed grinding can be done dry without metallurgical injury is established by the typical cut-off operation of broken high speed steel drills. It has been argued by some that in the case of cut-off, the ground surface is all ground away removing the evidence. However this is patently incorrect because if it is assumed that the cutting process produces enough heat to injure the steel of the ground surface, then there will be some evidence of this high heat source passage conducted to the sides of the cut drill, and this is not the case. I have also been involved with many high wheel speed dry cut-off operations on steel tubing where there is no evidence on the sides of the cut of the passage of a high level heat source.

With Energy Adaptive grinding, where the UVE is controlled to low values, I have ground M-50 HSS bearing races dry at 6000 fpm with no evidence of metallurgical injury found by laboratory investigation. Now that we have a handle on $HP_F$, it appears that dry grinding at higher velocities is feasible and preferable. It should also be pointed out that dry grinding is typically done on conventional Tool and Cutter grinders in sharpening all types of high speed steel cutters and tools. In that case the frictional heat is kept low by a combination of soft grade wheels, a narrow area of contact, and repeated wheel sharpening.

Fields of Application

Applications 2: In finish grinding the decrease in feed or feed rate can be coordinated with change in truing rate so as to reduce the friction power as the end of feed is approached. This is not the case in conventional grinding, and it will improve the part size accuracy and repeatability.

Applications 3: There is one particular class of round part that has always been a real grinding problem, because it has such a large amount of radial stock removal. There are several prime examples that come to mind; ring roll dies, crankshaft main bearings with thrust faces, and crankshaft pin bearings with thrust faces. All three examples have in common extremely large radial stock removals, like 1" or more, but only in a narrow width such as 0.015" or 0.020" on the sidewalls, and yet when the sidewall has been ground the full width of the wheel face comes into grinding contact with the outside diameter. The vast disparity in requirements for fast sidewall grinding, and grinding the outside diameter without metallurgical injury are impossible for the conventional systems, which settle for a poor compromise at best. However with my new system, coordinated change in feed rate and truing rate can quickly change the condition of the wheel face as the transition from sidewall to outside diameter occurs. This will lead to a quantum jump in productivity and quality, and lower costs for this class of work. An additional benefit of the high wheel speed is the reduction in grinding force. It is anticipated that the roundness on crankshaft and crankpin bearings will be much improved as a result.

Having thus described my invention, what I claim as new and desire to secure by Letters Patent is:

1. In a grinding machine, the combination comprising a resin bonded grinding wheel mounted from rotation about its axis and means for rotationally driving the wheel, said wheel having a face engageable with a workpiece for producing grinding action; a truing element having an operative surface conforming to the desired shape of the wheel face in a direction parallel to the wheel axis; means for thermally insulating the truing element from the machine support to minimize heat flow from the truing element to the machine support; and means for relatively feeding the wheel face into relative rubbing contact with the operative surface of said truing element while heating the wheel face with heat from a source in addition to the normal friction between the wheel face and the truing element to weaken the resin binder sufficiently to release the worn grit material of the wheel and expose fresh grit material.

2. The grinding machine of claim 1 wherein said truing element has an operative surface made of particles of a grinding resistant material characterized by diamond, or cubic boron nitride, set in a strong matrix for the purpose of minimizing truing element wear and maintaining conformity with the shape of the desired wheel face.

3. A method of restoring or maintaining the face of a resin-bonded grinding wheel in a desired shape or sharpness, said method comprising, rotating the wheel and relatively feeding the wheel face into relative rubbing contact with the operative surface of a truing element while heating the wheel face with heat from a source in addition to the normal friction between the wheel face and the truing element to weaken the resin binder sufficiently to release the worn grit material of the wheel and expose fresh grit material.

4. The method of claim 3 wherein said wheel face is heated by heating said truing element sufficiently to raise the temperature of said wheel face in contact therewith to a temperature sufficient to weaken said resin binder and release worn grit material of the wheel and expose fresh grit material.

* * * * *